US005261198A

United States Patent [19]

McMillan

[11] Patent Number: 5,261,198

[45] Date of Patent: Nov. 16, 1993

[54] MODULAR CONCRETE CONNECTOR

[76] Inventor: Larry S. McMillan, 204 Upland Blvd., Las Vegas, Nev. 89107

[21] Appl. No.: 780,334

[22] Filed: Oct. 22, 1991

[51] Int. Cl.[5] ..... E04B 2/82

[52] U.S. Cl. ..... 52/127.12; 52/125.5; 52/252

[58] Field of Search ..... 52/127.12, 726, 227, 52/230, 252, 125.5, 125.1-125.4, 125.6; 403/305, 307

[56] References Cited

U.S. PATENT DOCUMENTS

| | | | |
|---|---|---|---|
| 277,778 | 5/1883 | Phelps . | |
| 518,793 | 4/1894 | Smith . | |
| 1,251,464 | 1/1918 | Becker . | |
| 1,689,281 | 10/1928 | Forssell . | |
| 2,251,189 | 7/1941 | Jensen . | |
| 3,033,600 | 5/1962 | Drysdale . | |
| 3,540,763 | 11/1970 | Yee . | |
| 3,552,787 | 1/1971 | Yee . | |
| 3,667,782 | 6/1972 | Viazzi . | |
| 3,922,946 | 12/1975 | Grayson . | |
| 3,943,817 | 4/1976 | Mess . | |
| 4,056,912 | 11/1977 | Case et al. . | |
| 4,074,499 | 2/1978 | Mess . | |
| 4,084,780 | 4/1978 | Mess . | |
| 4,095,389 | 6/1978 | Outram | 52/726 X |
| 4,114,344 | 9/1978 | Heasman . | |
| 4,143,986 | 3/1979 | Antosh . | |
| 4,165,104 | 8/1979 | van den Beld . | |
| 4,226,444 | 10/1980 | Bunyan . | |
| 4,441,837 | 4/1984 | Mastroni . | |
| 4,525,916 | 7/1985 | Wuhrer . | |
| 4,615,554 | 10/1986 | Schilla | 52/125.5 X |
| 4,619,096 | 10/1986 | Lancelot . | |
| 4,627,212 | 12/1986 | Yee . | |
| 4,692,052 | 9/1987 | Yee . | |
| 4,850,777 | 7/1989 | Lawrence | 403/305 X |
| 4,883,385 | 11/1989 | Kaler . | |
| 5,067,844 | 11/1991 | Baumer | 403/305 |

FOREIGN PATENT DOCUMENTS

| | | | |
|---|---|---|---|
| 100892 | 9/1925 | Austria . | |
| 756325 | 5/1967 | Canada | 52/125.5 |
| 132524 | 2/1985 | European Pat. Off. | 52/125.5 |
| 34919 | 8/1885 | Fed. Rep. of Germany . | |
| 548751 | 4/1932 | Fed. Rep. of Germany . | |
| 548721 | 5/1932 | Fed. Rep. of Germany . | |
| 1913912 | 10/1970 | Fed. Rep. of Germany | 52/125.5 |
| 2422747 | 3/1974 | Fed. Rep. of Germany . | |
| 3312458 | 10/1984 | Fed. Rep. of Germany | 52/125.5 |
| 3329374 | 2/1985 | Fed. Rep. of Germany | 52/125.5 |
| 4464026 | 7/1914 | France . | |
| 584478 | 3/1962 | Italy . | |

OTHER PUBLICATIONS

Official Gazette Entry (p. 930) of U.S. Pat. No. 3,540,763 issued Nov. 17, 1970 to Yee.

Official Gazette Entry (p. 228) of U.S. Pat. No. 3,552,787 issued Jan. 5, 1971 to Yee.

*Primary Examiner*—Carl D. Friedman

*Assistant Examiner*—Beth A. Aubrey

*Attorney, Agent, or Firm*—Richards, Medlock & Andrews

[57] ABSTRACT

A connector (10) is disclosed which serves the dual function of providing a threaded insert for threaded engagement with a lifting bolt to move the concrete casting and as a shear connection between the first concrete casting and a mating concrete casting. The connector (10) is cast within a first concrete casting (12). A threaded portion (18) is exposed at an edge of the casting which threadedly receives a lifting bolt. When the casting is being installed, an exposed reinforcing rod section (30) of the mating concrete casting is inserted within the threaded portion (18) and a grouting cavity (20) in the connector and the reinforcing bar is pressure grouted therein with epoxy, a metallic non-shrink grout or other suitable grout.

18 Claims, 2 Drawing Sheets

MODULAR CONCRETE CONNECTOR

TECHNICAL FIELD OF THE INVENTION

This invention relates to building construction using precast concrete modular sections.

BACKGROUND OF THE INVENTION

Precast concrete modular construction is a growing industry. In such construction, large, heavy precast concrete sections are molded in a casting mold or bed at a central location. This minimizes the capital investment necessary in the molds and provides good quality control. After the castings are molded, they are lifted from the mold and carried to a storage area until they are needed for the actual construction. At the proper time, the precast concrete castings are moved from the storage area to the construction site where they are assembled into building or other structures.

Over the years, techniques have been developed which facilitate the lifting of the heavy concrete castings from the casting mold or bed. U.S. Pat. No. 4,056,912 to Case et al. discloses a common threaded insert which is molded into the concrete casting. A threaded bolt on a lifting sling can be threaded into this insert to lift the concrete casting from the mold to the storage area, and later from the storage area to the installation site. At installation, the threaded insert is covered over or filled and has no further use.

Various techniques have also been developed for securing one concrete casting to another in the actual building structure. One such technique is disclosed in U.S. Pat. No. 4,627,212 issued to Yee. This patent discloses a splice sleeve which is used to connect reinforcing bar from mating concrete castings using a metallic non-shrink grout. The sleeve is precast in one of the concrete castings. The casting to which it is mated has a portion of reinforcing bar extending from the casting which is then received into the splice sleeve. Subsequently, the reinforcing bar is grouted to the splice sleeve with pressure grouting. This splice sleeve has been found to provide an adequate shear connection between the concrete castings.

The lifting devices of the type disclosed in the Case patent, and the shear connectors such as shown in the Yee patent are completely separate components. This requires the expenditure for both these types of components in each construction job.

SUMMARY OF THE INVENTION

In accordance with one aspect of the present invention, a connector is provided for use with concrete castings containing reinforcing bar. The connector includes a body having a first portion that is threaded and a second portion that is threadable. The body also includes a cavity portion which is positioned between the first and second portions. The second portion is threaded to a reinforcing bar within a first concrete casting with the first portion of the body exposed at an edge of the first concrete casting. A threaded lifting bolt is threaded into the first portion to lift the first concrete casting. The first portion and the cavity portion receives a reinforcing bar from a second concrete casting with the reinforcing bar grouted therein with a metallic non-shrink grout, epoxy or other grout material.

In accordance with another aspect of the present invention, a connector is designed to receive any size and type of threaded bolt or rod in the first portion and a threaded reinforcing bar in the second portion. In another embodiment, the connector is designed to accept a two and one-half inch coil rod in the first portion and reinforcing bar in a size range from eight to twelve in the second portion. In another embodiment, the connector is designed to accept a one and one-half inch coil rod in the first portion and to accept reinforcing rod in a size range from three to six in the second portion.

In accordance with another aspect of the present invention, the body has a predetermined external diameter and the second portion has at least one wing extending radially outward of the external diameter.

In accordance with another aspect of the present invention, the cavity portion has at least one radially inwardly extending ridge to enhance adhesion between the reinforcing bar grouted therein.

BRIEF DESCRIPTION OF THE DRAWINGS

For a more complete understanding of the present invention and the advantages thereof, reference is now made to the following description taken in conjunction with the accompanying drawings, in which.

DETAILED DESCRIPTION

Figure 1:
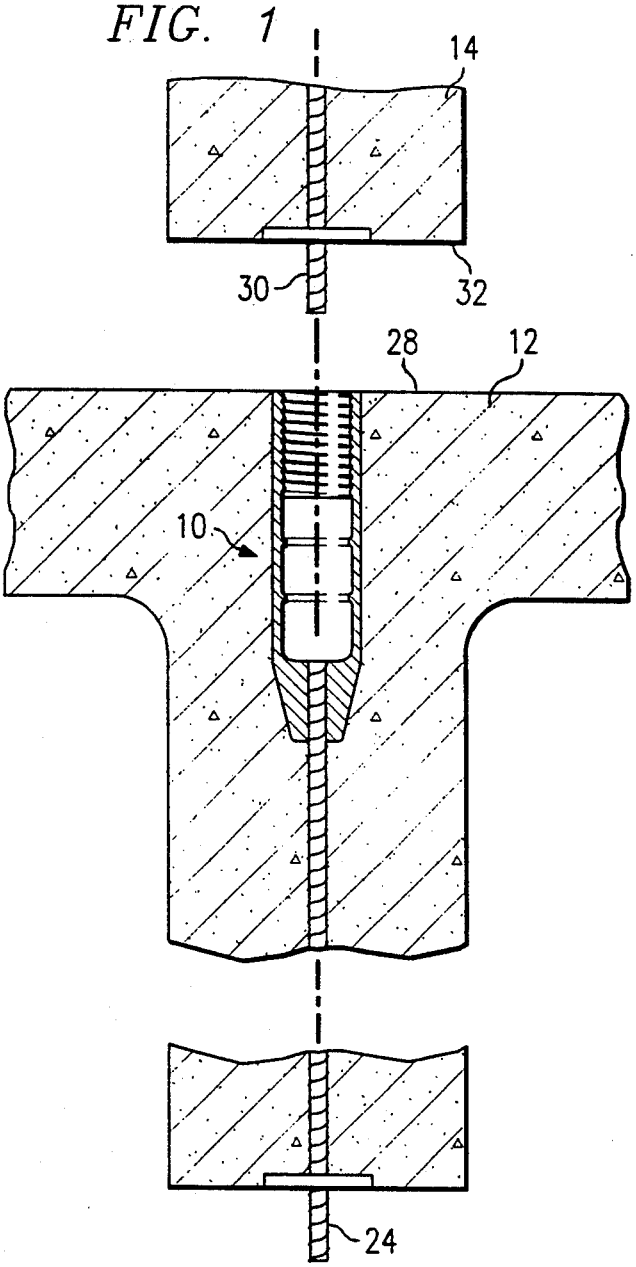
FIG. 1 is an illustration of a connector forming a first embodiment of the present invention cast within a modular concrete casting.
Figure 2:
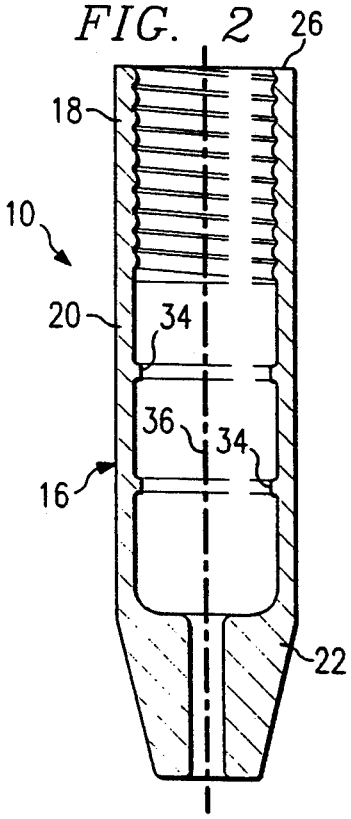
FIG. 2 is a cross-sectional view of the connector.
Figure 3:
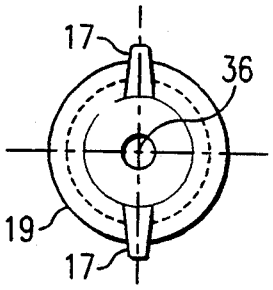
FIG. 3 is an end view of the connector.
Figure 4:
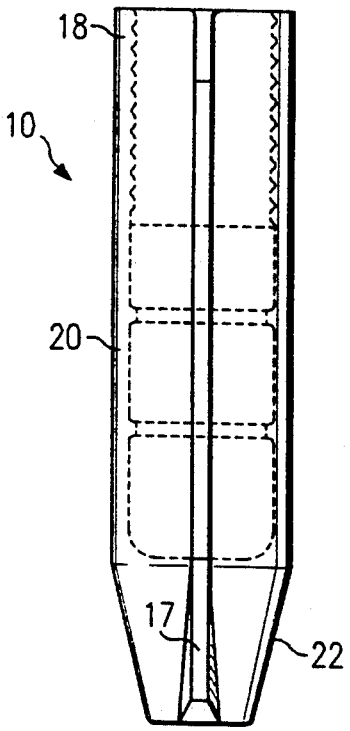
FIG. 4 is an external view of the connector.
Figure 5:
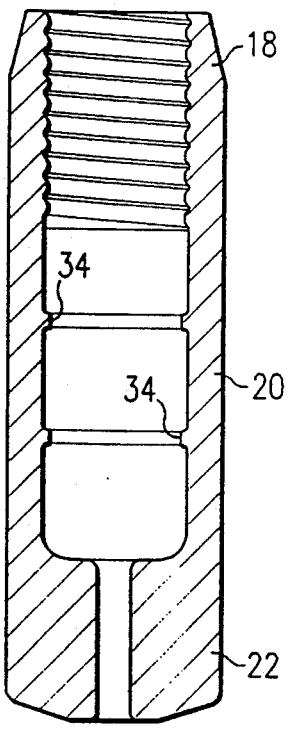
FIG. 5 is a cross-sectional view of the connector taken along lines 5—5 in FIG. 4.
Figure 6:
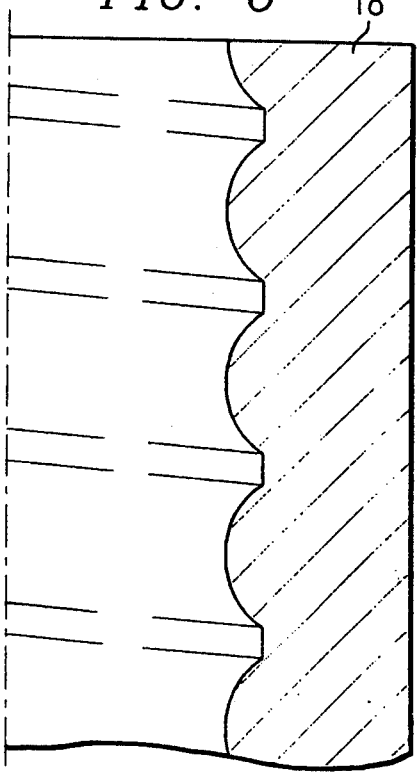
FIG. 6 is a detailed cross-section view of the threads.

With reference now to the accompanying drawings, and in particular to FIG. 1, a connector 10 is illustrated which forms a first embodiment of the present invention. As will described in detail hereinafter, the connector 10 can be used both for lifting a precast concrete casting or panel 12 from one location to another and to provide an effective shear connection between that casting 12 and a mating casting 14 as the structure is assembled. Thus, the present invention achieves results which required two totally separate devices previously.

With reference to FIGS. 2–6, the connector 10 can be seen to be a generally cylindrical body 16 which is divided into a coil rod threaded portion 18, a grouting cavity 20 and a reinforcing bar threadable portion 22. Triangular wings 17 extend radially outward from the center axis 36 of the connector beyond the outer diameter 19 of the body to more securely anchor the connector 10 in the casting 12.

The connector 10 is designed to be threaded onto a reinforcing bar 24 prior to the molding of casting 12. The connector 10 and reinforcing bar 24 are positioned in the mold so that the casting 12 is molded about both the reinforcing bar and the connector 10, leaving only end 26 of the connector exposed at one edge 28 of the casting 12. Thus, the connector is well secured within the body of the casting 12, particularly through its threaded connection with the reinforcing bar 24. Bar 24 need not be reinforcing bar, but can be any suitable bar or rod as desired.

After casting 12 has been molded, a conventional threaded screw or coil rod on a lifting sling can be threaded into the threaded portion 18. The conventional lifting equipment can then move the casting 12 from the casting mold or bed and move it to a storage area. Similarly, the casting can be moved from the storage area to the construction site in due course.

When the casting 12 is installed in the building or structure being assembled, the mating casting 14 which mates with casting 12 along the edge 28 of the casting 12 can be connected through connector 10 to provide an effective shear connection. As seen in FIG. 1, the casting 14 will have an exposed section of reinforcing bar 30 extending from the edge 32 of the casting 14 which is intended to mate with the edge 28 of casting 12. This exposed section of reinforcing bar 30 will be inserted into the threaded portion 18 and the grouting cavity 20 so that the end of the reinforcing bar 30 is proximate the end of the reinforcing bar 24. The threaded portion 18 and the grouting cavity 20 can then be filled with a metallic non-shrink grout, epoxy or other ground material to secure the rebar 30 to the connector 10. Preferably, the grouting cavity 20 will have a series of radially inwardly directed ridges 34 which enhance the adhesion between the grouting, the connector and the reinforcing bar.

Thus, as can be readily understood, the connector 10 serves a dual purpose, initially providing a lifting attachment for lifting and moving the heavy concrete castings. It further provides for a shear connection between mating castings in the final construction. The dual function of connector 10 cannot be achieved by the devices in use today. A typical lifting coil insert could not have a reinforcing bar grouted into the coil and develop sufficient strength to use the insert as a shear connection. Similarly, the splice sleeve disclosed in the Yee patent is adequate to form a continuous shear connection between concrete components. However, this splice sleeve would not allow one to lift the component in which the sleeve is cast with safety because the lifting forces would be transferred through the grout, which is not intended to transfer such forces.

In one embodiment of connector 10, the connector is adapted for use with two inch coil rod in the threaded portion 18. The threaded portion 18 is 76 mm long along the axis 36 of the connector. The interior diameter of the cavity 20 is 54 mm while the ridges 34 extend radially inward to an inner diameter of 47 mm. The length of the cavity 20 is approximately 114 mm and each ridge 34 has a length of about five mm. The threaded portion 22 is approximately 55 mm long and has a prethreaded diameter of 14 mm to accept rebar in the size range between five and eight. Generally, rebar is identified by a number which represents the number of one-eighth inch increments in the diameter of the bar. For example, a size five bar has a diameter of five-eighths inch. The wings taper from 11 mm to 7 mm in thickness and extend about 7 mm from the outer surface of the body. Of course, metric size bar could also be used.

In another connector built in accordance with the teachings of the present invention and adapted for receiving two and one-half inch coil rod in the threaded portion 18, the threaded portion 18 is about 76 mm in length. The cavity 20 is approximately 164 mm long and has an internal diameter of 63 mm. The ridges 34 extend radially inward to a diameter of 60 mm and are five mm long. The threaded portion 22 is approximately 61 mm long and the prethreaded diameter of the threaded portion 22 is 19 mm adapted to accept rebar in the size range between eight and twelve. The wings taper from 11 mm to 7 mm in thickness and extend about 7 mm radially from the outer surface of the body.

In accordance with another connector formed in accordance with the teachings of the present invention adapted for use with one and one-half inch coil rod threaded into the threaded portion 18, the threaded portion 18 is about 76 mm in length. The cavity 20 is about 114 mm in length and has an internal diameter of about 41 mm. The ridges 34 extend inwardly to a diameter of 35 mm and have a length of five mm. The threaded portion 22 has a length of 35 mm and a prethreaded internal diameter of 7.5 mm, adapted to threadedly engage reinforcing bar within size ranges between three and six. The wings taper from 11 mm to 7 mm in thickness and extend about 7 mm radially out from the outer surface of the body.

The connector is designed to have mechanical properties in conformance with ASTM standard 536-80 with a minimum yield strength of 60,000 psi and a minimum tensile strength of 85,000 psi. The material has a minimum of 6% elongation in 50.8 mm gauge length.

Although a single embodiment of the invention has been illustrated in the accompanying drawings and described in the foregoing detailed description, it will be understood that the invention is lot limited to the embodiments disclosed, but is capable of numerous rearrangements, modifications and substitutions of parts and elements without departing from the scope and spirit of the invention.

I claim:

1. A connector for use with concrete castings containing a bar, comprising:

a body having a first portion that is threaded and a second portion that is threadable, said body further having a cavity portion between said first and second portions;

the second portion threaded to a bar within a first concrete casting, at least the second portion molded within the first concrete casting, the first concrete casting having an edge the first portion exposed at the edge of the first concrete casting, a threaded lifting member threaded into the first portion to lift the first concrete casting, the connector providing a direct mechanical threaded connection between the bar in the first concrete casting and the threaded lifting member; and the first portion and the cavity portion subsequently receiving a bar from a second concrete casting with the bar grouted therein to permanently secure the first and second concrete casting together with the grout to resist earthquake shear forces between the first and second concrete castings, the bar form the second concrete casting passing through the first portion without being threaded to the first portion.

2. The connector of claim 1 wherein said body has an exterior diameter, said second portion having at least one wing extending radially outward of the exterior diameter.

3. The connector of claim 1 wherein said cavity portion has at least one radially inwardly extending ridge to enhance adhesion between the cavity and the bar grouted therein.

4. The connector of claim 1 wherein the first portion is threaded to receive a one and one-half inch coil rod and the second portion is threadable to receive a reinforcing bar in the size range between three and six.

5. The connector of claim 1 wherein the first portion is threaded to receive a two inch coil rod and the second portion is threadable to receive a reinforcing bar in the size range between five and eight.

6. The connector of claim 1 wherein the first portion is threaded to receive a two and one-half inch coil rod and the second portion is threadable to receive a reinforcing bar in the size range between eight and twelve.

7. The connector of claim 1 wherein the grout is selected from the group consisting of metallic non-shrink grout and epoxy.

8. A connector for use with a concrete casting containing a bar, comprising:

an elongate body having a central axis, the body further having a first portion with concrete casting lifting threads, a second portion forming a concrete casting shear resistant grouting cavity and a third portion having a re-enforcing bar threadable passage, the portions positioned sequentially along the central axis;

the lifting threads having sufficient strength to lift the connector and at least a portion of the concrete casting;

the grouting cavity shaped and configured to receive grout to create an earthquake shear resisting coupling between concrete castings.

9. The connector of claim 8 wherein the body further comprises structure extending from the body resisting movement of the body within the concrete casting.

10. The connector of claim 8 wherein said body has an exterior diameter, said connector having at least one wing extending radially outward of the exterior diameter.

11. The connector of claim 8 wherein the grouting cavity has at least one radially inwardly extending ridge to enhance adhesion between the cavity and the grout.

12. The connector of claim 8 wherein the firs portion is threaded to receive a one and one-half inch coil rod and the third portion is threadable to receive a reinforcing bar in the diameter size range between $\frac{3}{8}''$ and $\frac{3}{4}''$.

13. The connector of claim 8 wherein the first portion is threaded to receive a two-inch coil rod and the third portion is threadable to receive a reinforcing bar in the diameter size range between $\frac{5}{8}''$ and 1".

14. The connector of claim 8 wherein the first portion is threaded to receive a two and one-half inch coil rod and the third portion is threadable to receive a reinforcing bar in the diameter size range between 1" and $1\frac{1}{2}''$.

15. An apparatus, comprising:

a concrete casting having at least one bar therein and defining a top surface;

a connector imbedded in the concrete casting, the connector having a first portion with concrete casting lifting threads for lifting the connector and concrete casting, a second portion defining a concrete casting sheer resistant grouting cavity and third portion having threads engaging the bar in the concrete casting.

16. The apparatus of claim 15 wherein the connector further has structure extending into the concrete casting for resisting movement of the connector within the concrete casting.

17. The apparatus of claim 15 wherein the connector has a first end, the first end being flush with the top surface of the concrete casting.

18. An apparatus, comprising:

a first concrete casting containing at least one bar, the bar having a threaded end, the first concrete casting having a top surface;

a first connector embedded within the first concrete casting, the first connector having a first lifting threaded portion, a second portion having a grouting cavity and a third portion threaded to the threaded end of the bar in the first concrete casting, the connector having an upper end flush with the top surface of the first concrete casting;

a second concrete casting having at least one bar, the bar having a lower end and an upper end, the lower end extending outward from a bottom surface of the second concrete casting, the first and second concrete castings joined at their surfaces with the bar in the second concrete casting extending into the grouting cavity in the first connector, and a second connector embedded in the second concrete casting, the second connector having a first lifting threaded portion, a second portion having a grouting cavity and a third portion threaded to the bar in the second concrete casting at the upper end; and grouting within the grouting cavity of the first connector to grout the first and second concrete castings together to resist shear.

* * * * *